US006635106B2

(12) United States Patent
Katou et al.

(10) Patent No.: US 6,635,106 B2
(45) Date of Patent: Oct. 21, 2003

(54) DUST COLLECTING APPARATUS AND AIR-CONDITIONING APPARATUS

(75) Inventors: Ryou Katou, Aichi (JP); Yoshikazu Tashiro, Aichi (JP)

(73) Assignee: Matsushita Seiko Co., Ltd., Osaka (JP)

( * ) Notice: Subject to any disclaimer, the term of this patent is extended or adjusted under 35 U.S.C. 154(b) by 0 days.

(21) Appl. No.: 09/926,427

(22) PCT Filed: Feb. 26, 2001

(86) PCT No.: PCT/JP01/01402

§ 371 (c)(1),
(2), (4) Date: Oct. 31, 2001

(87) PCT Pub. No.: WO01/64349

PCT Pub. Date: Sep. 7, 2001

(65) Prior Publication Data

US 2003/0005824 A1 Jan. 9, 2003

(30) Foreign Application Priority Data

Mar. 3, 2000 (JP) ..... 2000-58462
Jul. 7, 2000 (JP) ..... 2000-206492

(51) Int. Cl.[7] ..... B03C 3/12
(52) U.S. Cl. ..... 96/67; 96/69; 96/79; 96/97
(58) Field of Search ..... 96/69, 96, 97, 96/99, 77–79, 67; 95/59, 79

(56) References Cited

U.S. PATENT DOCUMENTS 1,343,285 A * 6/1920 Schmidt ..... 95/79
5,573,577 A * 11/1996 Joannou ..... 96/66
5,766,318 A * 6/1998 Loreth et al. ..... 96/69
5,837,035 A * 11/1998 Braun et al. ..... 95/78
6,004,376 A * 12/1999 Frank ..... 95/79
6,077,334 A * 6/2000 Joannou ..... 96/66
6,117,403 A * 9/2000 Alix et al. ..... 423/210
6,245,126 B1 * 6/2001 Feldman et al. ..... 95/59
6,312,507 B1 * 11/2001 Taylor et al. ..... 96/19
6,364,935 B1 * 4/2002 Wennerstrom ..... 95/57
6,461,409 B1 * 10/2002 Neff et al. ..... 95/78
6,497,754 B2 * 12/2002 Joannou ..... 96/67

FOREIGN PATENT DOCUMENTS

| | | | |
|---|---|---|---|
| JP | 61-138550 | * | 6/1986 |
| JP | 62-83553 | * | 5/1987 |
| JP | 63-9238 | * | 1/1988 |
| JP | 6-31200 | * | 2/1994 |
| JP | 10-235221 | * | 9/1998 |
| JP | 3057123 | * | 12/1998 |
| TW | 84218209 | | 4/1994 |
| TW | 83205909 | | 12/1995 |

OTHER PUBLICATIONS

*References X'd were either cited in the specification or applicants' PCT application PCT/JP01/01402.*

* cited by examiner

*Primary Examiner*—Richard L. Chiesa
(74) *Attorney, Agent, or Firm*—Armstrong, Westerman & Hattori, LLP

(57) ABSTRACT

A dust is electrostatically charged using an ion-releasing device adapted to release only ionized air with occurrence of a corona discharge, thereby reducing the amount of power consumed and the amount of ozone generated to the utmost. An electric dust collector includes a charging section having a discharging electrode and an earthed electrode, a dust-collecting section having a voltage-applied electrode and an earthed electrode and an air feed fan. Dust introduced into the dust collector is electrostatically charged by breaking the air insulation by a corona discharge occurring in the charging section to produce ionized air and then removed in the dust-collecting section where an electric field is formed. However, because the corona discharge is generated, there is a problem that the discharged current is large, and the amount of power consumed and the amount of ozone generated are large.

13 Claims, 6 Drawing Sheets

DUST COLLECTING APPARATUS AND AIR-CONDITIONING APPARATUS

This application is a §371 of international application No. PCT/JP01/01402, filed Feb. 26, 2001.

FIELD OF THE INVENTION

The present invention relates to a dust collector which is designed to collect a dust in the outside air, a dust in a room or the like in an air-conditioning field and an industrial field, and which is provided with a charging section for electrostatically charging a dust without utilization of a corona discharge, wherein ozone is hardly generated, and to an air-conditioning system including such a dust collector.

BACKGROUND ART

There is such a conventionally known dust collector, for example, described in Japanese Patent Laid-open No. H6-31200. The conventionally known dust collector will be described below with reference to FIG. 8. As shown in FIG. 8, a charging section 101 comprises a linear electrode 102 and an earthed electrode plate A103. A dust-collecting section comprising a voltage applied electrode plate 105 and an earthed electrode plate B106 is mounted at a location downstream of the charging section 101 in an air-flowing direction. In usual, a voltage is applied to each of the linear electrode 102 and the voltage-applied electrode plate 105 by a high-voltage regulated power supply 107, so that there is a difference in potential in a range of 5 to 15 kV between the linear electrode 102 and the earthed electrode plate 103 in the charging section 101, and there is a difference in potential in a range of 2 to 6 kV between the voltage-applied electrode plate 105 and an earthed electrode plate B106 in the dust-collecting section 104.

In such arrangement, a high voltage is applied to the linear electrode 102 in the charging section 101, whereby a very intensive electric field is produced in the vicinity of the linear electrode 102. Therefore, a substance contained in air and having an electric charge collides with molecules of air, whereby electrons are separated from the molecules of air, and separated electrons are deposited to the air molecules to become ionized air. This is called the ionization of air herein. Air present as an insulating material between the earthed electrode and the linear electrode produces a dielectric breakdown and as a result, the ionization of the air occurs, while being accompanied by a large uniform discharged current. Such a discharging phenomenon is called a corona discharge. Ionized air produced by the corona discharge is deposited to a dust contained in the air supplied to the dust collector to electrostatically charge the dust. The electrostatically charged dust is introduced along a flow of fed air into the dust-collecting section 104 and deposited to either of the electrode plates under a force of an electric field between the voltage-applied electrode plate 105 and the earthed electrode plate B 106. In this manner, the dust is removed, and the cleaned air is blown out from the rear of the dust-collecting section 104. In the above conventional example, the linear electrode is illustrated as a discharging electrode, but even if another electrode having a shape forming an uneven electric field, e.g., a needle-shape is used, a corona discharge occurs likewise in a state in which a uniform current flows between a tip end of the needle-shaped electrode and the earthed electrode plate A 103, whereby a dust is electrostatically charged and removed in a similar mechanism.

There is also a conventionally known dust collector of a type in which the dust-collecting section 104 is replaced by a filter 108. Such conventionally known dust collector will be described below with reference to FIG. 9. As shown in FIG. 9, a charging section 101 comprising a linear electrode 102 and an earthed electrode plate A 103 and a filter 108 are mounted in the named order in an air-flowing direction. A conductive lattice plate 109 is placed at a location downstream of the filter 108 and connected to earth. Usually, a voltage is applied to the linear electrode 102 by a high-voltage regulated power supply 107, so that there is a difference in potential in a range of 5 to 15 kV between the linear electrode 102 and the earthed electrode plate A 103 in the charging section 101.

In the above arrangement, a corona discharge is produced in the vicinity of the linear electrode 102 in the charging section 101 to electrostatically charge a dust and at the same time, an electric field is generated between the linear electrode 102 and the lattice plate 109 by applying a voltage to the linear electrode 102, whereby a filter medium of the filter 108 is polarized by the electric field. The electrostatically charged dust introduced into the filter receives a force for causing the dust to flow along a polarized electric field within the filter medium toward a surface of a filter medium fiber. As a result, the dust is easy to become collected to the filter medium, and the dust collection performance is enhanced.

Such conventional dust collector is accompanied by a problem that a discharged current in the charging section for electrostatically charging the dust is large. If the discharged current is increased, the amount of power consumed and the amount of ozone (harmful to a human body) generated are increased and for this reason, it is required to electrostatically charge the dust in such a manner that the discharged current does not flow much.

In the charging section of the conventional electric dust collector, a plus voltage is applied to the discharging electrode in order to inhibit the amount of generated ozone. Therefore, the conventional dust collector suffers from a problem that minus ions commonly alleged to provide a good effect of relaxing a human's frame of mind cannot be released simultaneously with the electrical charging of the dust. Therefore, it is required that minus ions can be released simultaneously with the electrical charging of the dust without flowing of discharged current.

The conventional charging section is generally of an arrangement in which a linear electrode made of tungsten is used as a discharging electrode, and the earthed electrode plate is mounted in an opposed relation to the linear electrode. However, there is a problem that the delivery and reception of an electric charge occurs in all portions of a surface of the linear electrode simultaneously with the ionization of air in the vicinity of the linear electrode and for this reason, useless discharged current flows. Another problem is that the air cannot be ionized efficiently for the reason that it is difficult to intensify the electric field to more than before, because the surface of the linear electrode is smooth. A further problem is that charged particles such as electrons, ions and charged dust particles collide against the discharging electrode, whereby the discharging electrode is liable to be worn, because a high voltage is applied to the discharging electrode and a very intensive electric field is formed in the vicinity of the discharging electrode. Therefore, it is required that the air is ionized efficiently with useless discharged current eliminated, and the collision of the charged particles against the discharging electrode is reduced.

The conventional charging section is designed so that discharged current on the order of 10 to 20 $\mu$A per 0.1 m of the linear electrode and on the order of 100 to 200 $\mu$A per air flow rate of 1 $m^3$/min is permitted to flow, thereby providing a dust collection efficiency of 80% or more. Even when the needle-shaped electrode is used, discharged current on the order of 100 to 200 $\mu$A per air flow rate of 1 $m^3$/min flows, and likewise, a corona discharge is produced to electrostatically charge a dust. If the discharged current of such level flows, the following problem is encountered: the amount of power consumed is large, and ozone is also generated in an amount on the order of 20 ppb to 100 ppb, which is a level not good for the health of a human and which is more than a threshold value of odor, resulting in an uncomfortable ozone odor. Therefore, it is required that the discharged current is reduced remarkably, while ensuring a dust collection performance equivalent to that in the conventional dust collector.

In an air-conditioning system including a dust collector of the above-described type, a flow rate of air is large and a speed of air passing through the inside of the system is also large. Therefore, it is possible to provide a high dust collection performance with a pressure loss kept low by employing, as a measure for adding a dust-collecting function, an electric dust-collecting unit designed so that a dust charged using a corona discharge is collected in a dust-collecting section where the pressure loss is small. However, if the electric dust-collecting unit using the corona discharge is used, the following problem is encountered: The discharged current is larger and hence, the amount of power consumed is also increased. In addition, the amount of ozone generated is also increased to exert an adverse influence to a human's body and to provide an uncomfortable ozone odor. Even in the air-conditioning system provided with the electrical dust-collecting function, it is necessary to reduce the discharged current.

A charging section in a dust-collecting system of a type having a filter mounted in place of the dust-collecting section suffers from the same problem as that described above. In this case, it is required that a dust is electrostatically charged simultaneously with the polarization of a filter medium, while reducing the discharged current remarkably.

Further, a dust collector having a filter mounted in place of the dust-collecting section suffers from the following problem: As the speed of a dust passing through the filter, i.e., the speed of air flow on a surface of the filter is larger, a dust-collecting effect provided by a force of a electrostatically charged dust flowing along a polarized electric field within a filter medium toward a surface of a filter medium fiber is lost. For this reason, if the speed of air flow on the filter surface is larger, the dust-collecting performance of the filter is not increased, and the pressure loss in the filter is increased. Another problem is that if a lattice plate is not in aligned contact with the surface of the filter, the filter medium cannot be polarized efficiently and uniformly. Even in this case, it is required that the speed of air flowing through the surface of the filter is reduced, and the filter is polarized uniformly.

In addition, there is a problem that if the number of crests of the pleated shape of the filter is increased, it is difficult to work the conductive lattice plate, resulting in an increase in material cost. It is required that even if there is no lattice plate, an earthed surface can be formed at a location downstream of the filter.

It is an object of the present invention to provide a dust collector, wherein the above-described problems associated with the conventional dust collector are solved; a dust can be electrostatically charged in such a manner that the discharged current little flows, thereby ensuring a dust-collecting ability equivalent to that in the conventional dust collector and at the same time, minus ions having an effect of relaxing the frame of mind can be released; the air can be ionized more efficiently; it is possible to prevent the damage of the electrode such as the breaking of the linear electrode due to the deterioration thereof caused by the generation of a corona discharge, the wear of the tip end of the needle-shaped electrode and the like; a enhanced dust-collecting performance can be maintained without being degraded; and wherein when the dust-collecting section is replaced by the filter, a high dust-collecting performance can be maintained, while reducing the amount of power consumed remarkably, and an air-collecting system including a dust collector having the above-described features.

DISCLOSURE OF THE INVENTION

To achieve the above object, according to a first aspect of the present invention, there is provided a dust collector comprising an ion-releasing means for releasing ions without generation of a corona discharge, and a dust-collecting section placed at a location downstream of the ion-releasing means.

With the above arrangement of the dust collector according to the present invention, a dust can be electrostatically charged in such a manner that the discharged current hardly flows.

According to a second aspect, in addition to the feature of the dust collector of the first aspect, the ion-releasing means releases minus ions.

With the above feature of the collector according to the present invention, a dust can be electrostatically charged in such a manner that the discharged current hardly flows, and minus ions having an effect of relaxing the frame of mind can be released.

According to a third aspect, in addition to the feature of the dust collector of the first aspect, the ion-releasing means includes a single or a plurality of discharging electrodes which are linear electrodes, and earthed electrodes mounted on opposite sides of the linear electrode, the electrode connected to earth to provide discharged current of 1 $\mu$A or less per 0.1 m of the linear electrode upon application of a high voltage to the linear electrode, the earthed electrode being coated with an insulating material or a semiconductor.

With the above feature, a corona discharge is inhibited, and an amount of discharged current more than required is not permitted to flow, whereby the air can be ionized efficiently, and the collision of charged particles against the discharging electrode can be reduced.

According to a fourth aspect of the present invention, in addition to the feature of the third aspect, the ion-releasing means releases minus ions.

With the above feature, a dust can be electrostatically charged with little flowing of discharged current, and minus ions having an effect of relaxing the frame of human's mind can be released.

According to a fifth aspect of the present invention, in addition to the feature of the first aspect, the ion-releasing means includes a single or plurality of discharging electrodes which are needle-shaped electrodes having sharp tip ends.

With the above feature, an intensive electric field can be collected at one point per one electrode by forming the discharging electrode into a needle-shape, thereby limiting a electrode portion capable of delivering and receiving a charge. Thus, the corona discharge is inhibited to eliminate useless discharged current. In addition, by forming a very intensive electric field at a sharp tip end portion, the air can be ionized further efficiently, and at the same time, the collision of charged particles against the discharging electrode can be reduced.

According to a sixth aspect of the present invention, in addition to the feature of the fifth aspect, the ion-releasing means releases minus ions.

With the above feature, a dust can be electrostatically charged with little flowing of discharged current, and minus ions having an effect of relaxing the frame of human's mind can be released.

According to a seventh aspect of the present invention, in addition to the feature of the fifth aspect, an insulating material or semiconductor is mounted around a tip end portion of the needle-shaped electrode to produce no corona discharge.

With the above feature, a corona discharge is inhibited, and useless discharged current is further eliminated, whereby the air can be ionized efficiently, and the collision of charged particles against the discharging electrode can be reduced.

According to an eighth aspect of the present invention, in addition to the feature of the fifth aspect, the discharged current per one needle-shaped electrode is 1 $\mu$A or less.

With the above feature, no corona discharge is produced, and an amount of discharged current more than required is not permitted to flow, whereby only ions can be released efficiently, and at the same time, the collision of charged particles against the discharging electrode can be reduced.

According to a ninth aspect the present invention, in addition to the feature of the fifth aspect, one or less needle-shaped electrode is disposed per area of 40 mm square on an air flow surface.

With such feature, the discharged current can be reduced, while ensuring a dust collection performance equivalent to that in the conventional dust collector.

According to a tenth aspect of the present invention, in addition to the feature of the fifth aspect, a conductive lattice plate connected to earth is placed at a location downstream of the needle-shaped electrode, and a filter comprising a filter medium constituting the dust-collecting section is mounted between the needle-shaped electrode and the lattice plate.

With the above feature, by placing a filter having an insulating property and a polarizability in an electric field formed between the needle-shaped electrode and the lattice plate, the filter medium of the filter can be polarized and at the same time, a dust can be electrostatically charged, while reducing the discharged current remarkably.

According to an eleventh aspect of the present invention, in addition to the feature of the tenth aspect; the filter and the conductive lattice plate are formed into a pleated shape and disposed in such a manner that they are superposed one on another.

With the above feature, the flow speed of air on the surface of the filter can be reduced by forming the filter into the pleated shape, and the filter medium of the filter can be polarized efficiently and uniformly by forming the lattice plate into the pleated shape in conformation with the surface of the filter and superposing the lattice plate onto the filter in conformation with the surface of the filter.

According to a twelfth aspect, in addition to the feature of the fifth aspect; a filter comprising a filter medium is mounted at a location downstream of the needle-shaped electrode, the filter having a conductive layer formed thereon by applying a conductive coating onto a downstream surface of the filter, the conductive layer being connected to earth.

With the above feature, an earthed surface is formed on the downstream surface of the filter without provision of a lattice plate.

According to a thirteenth aspect of the present invention, in addition to the feature of the twelfth aspect, the filter is formed into a pleated shape.

With the above feature, the speed of air on the surface of the filter can be reduced by forming the filter into the pleated shape, and the filter medium of the filter can be polarized efficiently and uniformly.

According to fourteenth aspect of the present invention, there is provided an air-conditioning system comprising a dust collector according to any of the previous aspects.

With the above arrangement, the amount of power consumed and the amount of ozone generated can be reduced, whereby the air-conditioning system has a high dust collection performance.

According to a fifteenth aspect of the present invention, there is provided an air-conditioning system comprising a dust collector according to any of the fifth to thirteenth aspects, the dust collector being provided with a needle-shaped electrode mounted directly on a grille to provide a dust-collecting function of electrostatically charging a dust and collecting the dust in a dust-collecting section provided within the dust collector. In the air-conditioning system of the above arrangement, the grille and the needle-shaped electrode are integral with each other, and the dust-collecting section is incorporated in the air-conditioning system in such a manner that it is separated from the needle-shaped electrode.

In the air-conditioning system of the above arrangement, the grille and the needle-shaped electrode are integral with each other, and the dust-collecting section is incorporated in the air-conditioning system in such a manner that it is separated from the needle-shaped electrode.

BEST MODE FOR CARRYING OUT THE INVENTION

Figure 1:
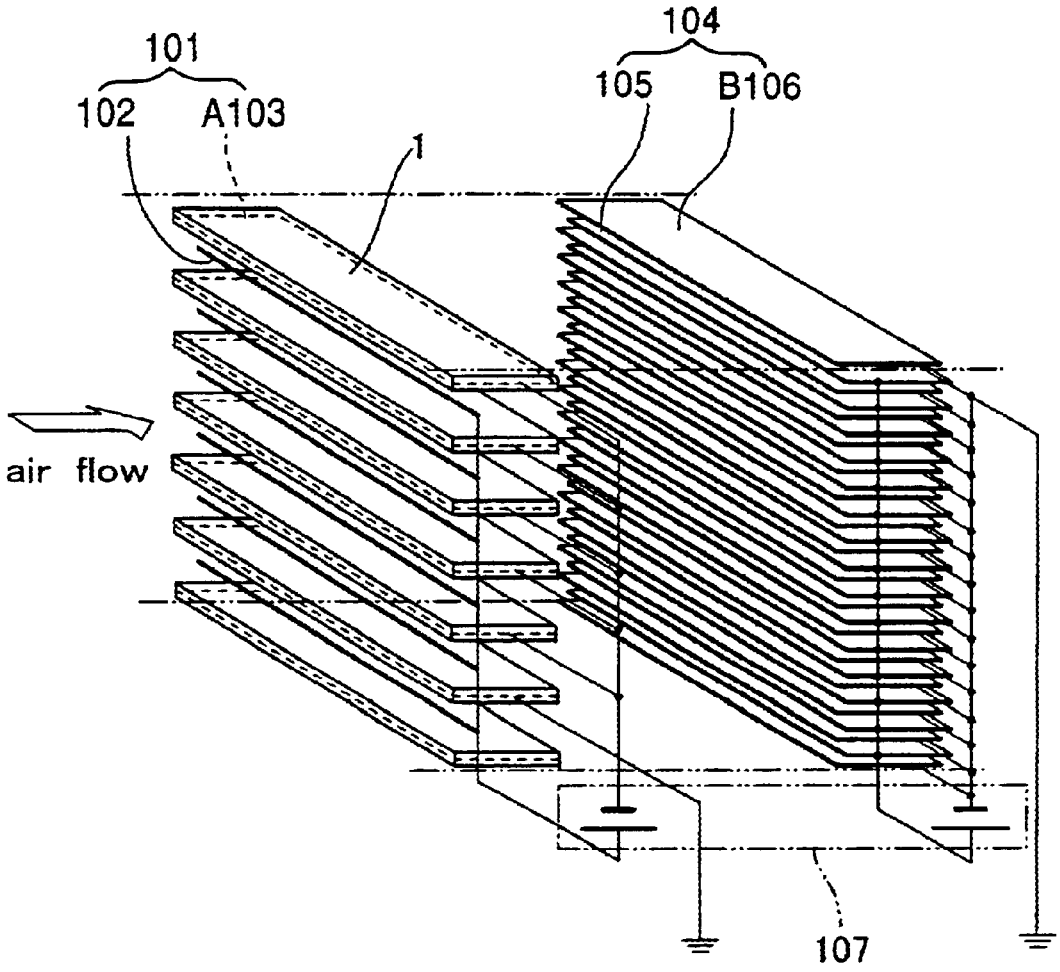
FIG. 1 is a diagram showing the arrangement of a dust collector constructed using linear electrodes according to an embodiment of the present invention.

A dust collector according to the present invention comprises an ion-releasing means for releasing ions without occurrence of a corona discharge, and a dust-collecting section disposed at a location downstream from the ion-releasing means. If a voltage equal to or larger than a given value is applied to discharge electrodes having a shape such as a needle-shape, a splinter-shape and a linear shape, in the vicinity of which earthed electrodes are mounted, a large electric field is formed in the vicinity of the discharging electrode. Thus, electrons in air molecules are separated, and the separated electrons are bonded to other air molecules, whereby the air molecules are ionized to provide ionized air. The generated ionized air is diffused by the force of the electric field and deposited to a dust to electrostatically charge the dust.

In a former common sense, it is effective to use a corona discharge as a measure for electrostatically charging a dust in a position upstream of the dust-collecting section. To produce the corona discharge, an earthed electrode is mounted in an opposed relation to a linear electrode or a needle-shaped electrode, and a high voltage is applied between both of these electrodes. If so, current hardly flows up to a certain magnitude of voltage. In this case, ionized air is also hardly generated. However, if the voltage is increased to a level at which a corona discharge occurs, an intensive electric field is produced around the discharging electrode, whereby the gas (air) produces an dielectric breakdown and as a result, is ionized, and the current value is raised suddenly by the discharge. This is a corona discharge. By utilizing a region of the corona discharge having a feature that the discharged current is large, the air can be ionized to electrostatically charge a dust. However, ozone is produced in proportion to the discharged current and hence, the corona discharge is accompanied by a large amount of ozone. When the corona discharge is minus, the amount of ozone produced is larger (about three to six times the amount of ozone produced in the plus corona discharge). If the discharged current is large, the amount of power consumed is increased. Therefore, the present inventors have found a measure for maintaining a performance of electrostatically charging a dust, while inhibiting the generation of ozone and the consumption of power by producing ionized air, while inhibiting the discharged current. More specifically, the earthed electrode is coated with an insulating substance or a semiconductor substance, or the earthed electrode is placed at a distance from the discharging electrode, whereby the insulation by the air is increased, so that only ions are released without occurrence of a corona discharge, and in other words, the air is ionized without occurrence of dielectric breakdown (this is defined as being an ionization discharge). Thus, the consumption of power and the generation of ozone can be reduced in a state in which discharged current little flows, while maintaining an electrostatically dust-charging performance provided by the deposition of the ionized air.

In a state in which no corona discharge has occurred, the discharged current is equal to or smaller than 1 $\mu$A (which is a level measurable by a common meter) per one needle-shaped electrode, or equal to or smaller than 1 $\mu$A per 0.1 m of a linear electrode. To make such a state, if air insulation and a sufficient distance are not provided, it is necessary to coat a portion of earthed electrode with an insulating material or a semiconductor material. For an air insulation, it is necessary to provide an insulation distance of at least 10 mm/kV or more, preferably 20 mm/kC or more, depending on the diameter and the smoothness of a surface in a case of a linear electrode, or depending on the degree of sharpening in a case of a needle-shaped electrode. An insulating material or a semiconductor material may be used, which exhibits an insulation resistance providing discharged current equal to or smaller than 1 $\mu$A but varied depending on an insulation distance.

The dust collector has a feature that the ion-releasing means releases minus ions. Specifically, a minus voltage is applied to the discharging electrode to ionize the air, and resulting plus ions are attracted and deposited to the electrode, whereby they are restored to gas molecules, and resulting minus ions are repulsed and diffused to surroundings. The earthed electrode is coated with an insulating substance or a semiconductor substance, or the distance between the discharging electrode and the earthed electrode is increased, so that the air is ionized without occurrence of a corona discharge accompanied by the generation of large discharged current. A minus voltage is applied to the discharging electrode to produce only minus ions, whereby the discharged current can be reduced to reduce the generation of ozone, while maintaining an electrostatically dust-charging performance provided by the deposition of ionized air, and the same time, minus ions alleged to provide an influence convenient for a human body can be released.

The dust collector further has a feature that the ion-releasing means includes a single or a plurality of discharging electrodes which are linear electrodes, and earthed electrodes are mounted on opposite sides of the linear electrode and coated with an insulating material or a semiconductor, so that the discharged current provided upon application of a high voltage to the linear electrode is equal to or smaller than 1 $\mu$A per 0.1 m of the linear electrode. When a corona discharge occurs, a local dielectric breakdown occurs to ionize the air, and the air locally produces a dielectric breakdown and hence, the discharged current is steeply increased. The discharged current represents an amount of delivery and reception of charge occurring on the surfaces of the discharging electrode and the opposed earthed electrode, and has a feature that it is in close proportional relation to the amount of power consumed and the amount of ozone generated. Therefore, the occurrence of the corona discharge can be inhibited by limiting the delivery and reception of the charge by the surfaced of the electrodes by coating the earthed electrode with the insulating material or the semiconductor, so that no discharged current flows, whereby the air can be ionized efficiently. Thus, it is possible to provide an amount of ionized air enough to electrostatically charge the dust with discharged current of 1 $\mu$A per 0.1 m of the linear electrode. From the above reason, the discharged current can be reduced substantially from the level in the prior art and hence, the amount of power consumed and the amount of ozone generated can be reduced to the utmost. If there are the plurality of linear electrodes, they are usually disposed in parallel to the air flow section and hence, ions are released uniformly over the air flow section and thus, the dust passed through the ion-releasing section can be electrostatically charged uniformly. Because the earthed electrode is coated with the insulating material or the semiconductor, the corona discharge hardly occurs. (When the voltage is increased, the dielectric breakdown rather than the corona discharge occurs and is switched over to a spark discharge). Therefore, ions can be released without being less influenced by the voltage. The discharged current is very low, and charged particles such as electrons, ions and electrostatically charged dust particles less collide against the surface of the discharging electrode and hence, it is possible to inhibit the breaking of the discharging electrode due to the wearing to prolong the life of the discharging electrode.

Further, the dust collector has a feature that the discharging electrode of the ion-releasing means is a needle-shaped electrode having a sharp tip end. An intensive electric field portions can be collected at one point per one electrode by forming the discharging electrode into the needle shape to limit a portion of the electrode capable of delivering and receiving a charge, thereby inhibiting the occurrence of a corona discharge to eliminate useless discharged current. Therefore, it is possible to remarkably reduce the amount of power consumed and the amount of ozone generated in close proportional relationship to the discharged current. Further, because the air can be ionized efficiently, the dust can be electrostatically charged more easily by a large amount of released ions. Unlike the entire linear electrode required to be small in diameter, the needle-shaped electrode may be sharp at its tip end and hence, is not accompanied by a problem that it is broken due to the damage. In addition, the discharged current is very low, and charged particles such as electrons, ions and electrostatically charged dust particles less collide against the surface of the discharging electrode and hence, it is possible to inhibit the breaking of the discharging electrode due to the wearing to prolong the life of the discharging electrode.

Yet further, the dust collector has a feature that an insulating material or a semiconductor is mounted around a tip end portion of the needle-shaped electrode. In this case, the earthed electrode is coated with the insulating material or the semiconductor, or the distance between the discharging electrode and the earthed electrode is increased to provide a state in which discharged current hardly flows. Therefore, it is possible to substantially eliminate the consumption of power and the generation of ozone. In addition, there is little discharged current, and charged particles such as electrons, ions and electrostatically charged dust particles less collide against the surface of the discharging electrode and hence, it is possible to inhibit the wearing of the sharp tip end portion to prolong the life of the discharging electrode.

Yet further, the dust collector has a feature that the discharged current is equal to or lower than 1 $\mu$A per one needle-shaped electrode. Specifically, the earthed electrode is coated with the insulating material or the semiconductor, or the distance between the discharging electrode and the earthed electrode is increased, whereby a number of ionized air equal to or larger than 100,000/cc can be produced as in the prior art by ionizing the air without occurrence of a corona discharge. Even if the voltage applied to the discharging electrode is increased to a double level, while maintaining a dust collection performance equal to a level in the prior art, the amount of power consumed is as small as 1/50 of that in the prior art, because of the discharged current is suppressed, and the amount of ozone generated is equal to or smaller than 1 ppb and in such level, there is actually even an odor.

Yet further, the dust collector has a feature that one or less needle-shaped electrode is disposed per an area of 40 mm square on the air flow surface. In the prior art, at least one or more needle-shaped electrode is disposed per 20 mm square on the air flow surface, and the number of the needle-shaped electrodes in the dust collector according to the present invention is 1/4 or less of that in the prior art. If the air is blown to flow in the dust collector at a speed of 1 m/sec, the number of the needle-shaped electrodes is 10 or less per 1 $m^3$/min. In this case, it is required that the discharged current is at largest 15 $\mu$A or less, thereby inhibiting the amount of power consumed and the amount of ozone generated. In this manner, the number of the needle-shaped electrode in the entire dust collector is reduced for an optimization. This ensures that the air can be ionized, while reducing the discharged current, thereby producing 100,000/cc of ionized air as in the prior art and thus, a dust collection performance equivalent to that in the prior art can be provided with the amount of power consumed and the amount of ozone generated smaller than those in the prior art.

Yet further, the dust collector has a feature that a conductive lattice plate connected to earth is placed at a location downstream of the needle-shaped electrode, and a filter comprising a filter medium constituting the dust-collecting section is mounted between the needle-shaped electrode and the lattice plate. A sufficient insulating distance is ensured between the needle-shaped electrode and the lattice plate, and the filter having an insulating property is placed between the needle-shaped electrode and the lattice plate and hence, the discharged current flowing between the needle-shaped electrode and the lattice plate is smaller than that in the prior art. Therefore, it is possible to remarkably reduce the amount of power consumed and the amount of ozone generated exerting an influence not good for the health of a human body. The corona discharge hardly occurs in the vicinity of the needle-shaped electrode as presumed from the very small discharged current, but the ionization of the air is produced by an ionization discharge in the vicinity of the needle-shaped electrode to which the high voltage is applied Therefore, ionized air is released and can be deposited to the dust to electrostatically charge the dust. Since the filter having a polarizability is disposed between the needle-shaped electrode and the lattice plate connected to the earthed electrode, the filter medium is polarized in unit of filter medium fiber by the electric field between the needle-shaped electrode and the lattice plate. This polarization is continued as long as the electric field is between the needle-shaped electrode and the lattice plate, ie., as long as the high voltage is being applied to the needle-shaped electrode and hence, the filter medium can be always polarized. The electrostatically charged dust passed through the filter medium receives a force for moving such dust toward the surface of the filter medium fiber along the polarized electric field within the filter medium under Coulomb action, and hence, is liable to be deposited to the filter medium. In addition, the dust also receives a polarizing action to become polarized by the polarized electric field in the filter medium and hence, even the dust not electrostatically charged receives an action for moving such dust toward the surface of the filter medium fiber along the polarized electric field in the filter medium to an extent not so large as the electrostatically charged dust. Therefore, the dust is liable to be deposited to the filter medium and thus, it is possible to exhibit a dust collection performance higher than that in the case of only the filter. To enhance the dust collection performance, the filter medium may be strongly polarized and hence, the voltage applied to the discharging electrode maybe increased. However, if the voltage is increased, the discharged current is increased to a level higher than that provided hitherto and for this reason, there is a limit to increase the voltage applied. However, the dust collector according to the present invention is of such a structure that the discharged current is originally very small, and even if the voltage is increased, the discharge current is difficult to flow. Therefore, in the dust collector according to the present invention, it is easy to set the voltage applied to the discharging electrode at a high level. As described above, the discharged current can be reduced remarkably and further, the inside of the filter can be always in a polarized state and hence, a high dust collection performance can be maintained, while remarkably reducing the amount of power consumed and the amount of ozone generated.

Yet further, the dust collector has a feature that the filter and the conductive lattice plate are formed into a pleated shape and disposed in such a manner that they are superposed one on another. The amount of air flow per unit surface area of the filter can be reduced by forming the filter into the pleated shape to increase the area of the filter and hence, the speed of air flow on the surface of the filter can be reduced. Therefore, the speed of dust passed through the filter medium can be reduced. The speed of dust moved toward the surface of the filter medium fiber along the polarized electric field within the filter medium is basically not influenced by the speed of dust passed through the filter and hence, the higher the speed of air flow on the surface of the filter, the longer the time taken for the dust to be deposited on the surface of the filter medium fiber, leading to an enhanced dust collection performance. In addition, the smaller the speed of air passed through the surface if the filter, the smaller the pressure loss in the filter and hence, as the speed of air flow on the surface of the filter is smaller, the energy taken for the air flow is smaller, and a sound such as a swishing sound of the air passed through the filter and a noise of a fan can be reduced. In addition, since the conductive lattice plate connected to the earth is formed into the pleated shape conformed to the surface of the filter and is of such a structure that it is in substantially uniform contact with the filter medium, the entire surface of the filter medium can be polarized uniformly, resulting in an enhancement in dust collection performance. Further, the degradation of the dust collection performance can be prevented by applying a polarizing effect to the filter medium to escape extra charge within the filter medium provided by the electrostatically charged dust and the ions. By providing the structure in which the lattice plate and the surface of the filter medium are in contact with each other, the extra charge is easily transmitted to the lattice plate and thus escaped, and hence, a high dust collection performance can be maintained. As described above, because the speed of air passed through the surface of the filter, a high dust collection performance can be achieved and at the same time, the energy of blowing the air and the noise can be reduced. In addition, because the conductive lattice plate connected to the earth is of the pleated shape conformed to the surface of the filter, the filter medium can be polarized uniformly to provide a high dust collection performance and at the same time, the enhanced dust collection performance can be maintained.

Yet further, the dust collector has a feature that a filter comprising a filter medium is mounted at a location downstream of the needle-shaped electrode, the filter having a conductive layer formed thereon by applying a conductive coating onto a downstream surface of the filter medium, the conductive layer being connected to earth. By applying the conductive coating to a back of the filter and connecting such surface to earth, the earthed surface can be formed downstream of the filter without provision of a conductive lattice plate connected to earth. Therefore, it is possible to simplify the manufacture of the dust collector to reduce the working or processing cost and the material cost.

An air-collecting system has a feature that it includes a dust collector. The air-collecting system has an air-conditioning function and a dust-collecting function with a lower pressure loss. Thus, the amount of power consumed and the amount of ozone generated can be suppressed to a level smaller than that in the prior art, thereby providing a high dust collection function, while reducing the adverse influence to a human body due to ozone and the feeling of discomfort.

An air-conditioning system has a feature that the dust collector is provided with a needle-shaped electrode mounted directly on a grille to provide a dust-collecting function of electrostatically charging a dust and collecting the dust in a dust-collecting section provided within the dust collector. Specifically, the air-conditioning system is of a structure that the needle-shaped electrode is mounted inside the grille, so that the needle-shaped electrode is brought into contact with the air flow, while preventing the needle-shaped electrode from being touched with a human's hand. In addition, the thickness of the system body can be reduced by forming the grille and the needle-shaped electrode integrally with each other, and only the dust-collecting section can be washed by separating the dust-collecting section and replaced by another one, leading to an enhanced maintenance.

Embodiments (Dust-collection Test Example 1 in Dust Collectors According to the Embodiment and in Conventional Dust Collector)

In the dust-collection test example 1, discharge currents, concentrations of ions, dust-collection efficiencies and concentrations of ozone were compared with one another using a dust collector according to the present invention and a conventional dust collector, each of which includes an ion-releasing means, as described below.

Figure 8:
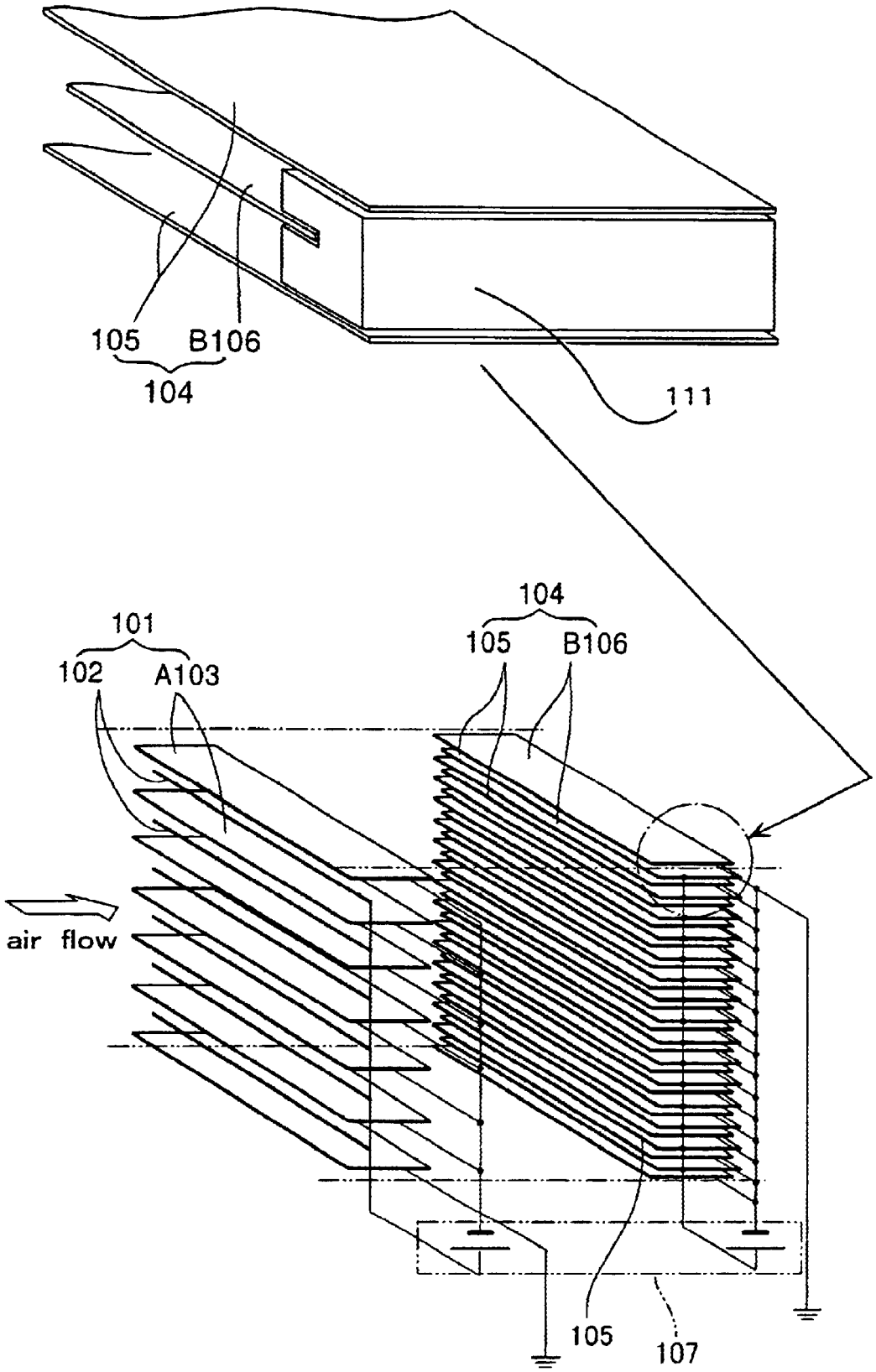
FIG. 8 PRIOR ART
FIG. 8 is a diagram showing the arrangement of a conventional dust collector.

First, an experiment device was fabricated based on the conventional dust collector shown in FIG. 8. This device will be described with reference to FIG. 8. Thirty-one stainless steel plates each having a thickness of 0.5 mm, a length of 50 mm and a width of 256 mm are superposed one on another at distances of 3 mm with a spacer 111 made of a polypropylene interposed between the every three stainless steel plates. A voltage of +2 kV was applied to every other even stainless steel plates, so that each of these stainless steel plates functioned as a voltage-applied electrode plate 105. Each of the stainless steel plates disposed with the voltage-applied electrode plate 105 interposed therebetween were connected to earth to function as an earthed electrode plate B 106, thereby fabricating a dust-collecting section 104. A charging section is placed under conditions shown in Table 1 at a location 400 mm spaced in an upstream direction apart from the dust-collecting sections 104, and a DC current as shown in Table 1 was applied to a linear electrode 102 using a high-voltage regulated power supply 107. A measured discharged current was converted into a discharged current per 1 $m^3$/min. A blower was mounted in rear of a duct to blow air under such a condition that an amount of air flow into the duct was 1 $m^3$/min, and a dust collection efficiency $\eta(\%)$, an amount of ions generated (number/cc) and a concentration of ozone generated (ppb) were measured. A speed of air flow at that time was about 0.5 m/sec. The dust collection efficiency was determined by measuring a concentration of dust just before the charging section 101 and just after the dust-collecting section 104 by use of Particle Counter KC-01C made by Rion, Co. The concentration of dust was measured in a counting manner, i.e., determined by sampling 0.167 liter of air and measuring the entire number of dust particles contained in such amount of air and having a particle size of 0.3 μm or more. If the concentration of dust just before the charging section 101 is represented by Cf, and the concentration of dust just after the dust-colleting section 104 is represented by Cb, the dust collection efficiency η can be determined according to the following equation:

$$\eta=(1-Cb/Cf)\times 100(\%)$$

The concentration of ions in the air was measured using Ion Tester LST-900 made by Kobe Denpa, Co., for metering a number concentration of small ions having an electric mobility of 0.4 $cm^2/V\cdot sec$ or more. A unit of this concentration was number/cc.

The concentration of ozone generated was measured using Ozone Monitor EG2001F made by Ibara Jitsugyo, Co., by sampling the air within the duct from just before the dust-collecting section 104. A unit of this concentration was ppb indicating a mass concentration of parts per billion.

The arrangement of each of the charging sections will be described below with reference to FIGS. 1, 2 and 8.

A charging section 101 in a first dust collector, which is a comparative example, is the same as that of the conventional charging section shown in FIG. 8, and comprises six linear electrodes 102, each of which is made using a wire of tungsten having a diameter of 0.15 mm and a length of 220 mm, which are placed at distances of 20 mm in a direction perpendicular to an air flow direction, and to which a voltage of +5.7 kV is applied, and seven earthed steel electrode plates A 103 having a length of 16 mm and a width of 220 mm as viewed in the air flow direction and placed at equal distances between the adjacent linear electrodes 102. The charging section 101 is a charging section of a shape conventionally used. In the charging section 101, the earthed electrode plates A 103 are placed above and below the linear electrodes 102 with only air present therebetween as an insulating material, so that, a corona discharge occurs between the adjacent electrodes, and the air is ionized in the vicinity of each of the linear electrodes 102. Therefore, a dust-collection performance with a dust collection efficiency as high as 95% can be realized. However, a corona discharge generating a large discharged current is liable to occur with the ionization of the air, resulting in the following disadvantages; then consumed power is increased because of the large discharged current on the order of 140 μA; an amount of ozone as relatively large as 24 ppb is generated because of the large discharged current; and minus ions are absorbed by the linear electrodes 102 and are hardly released, because the polarity of the linear electrodes 102 is plus.

A charging section 101 in a second dust collector, which is a comparative example, is of the same arrangement as the conventional charging section shown in FIG. 8, and in which the polarity of the linear electrodes 102 is minus, and a voltage is applied to the linear electrodes 102, so that the magnitude of the discharged current is equal to that in the charging section 101 in the first dust collector, which is 140 μA. As in the charging section in the first dust collector, an earthed electrode plate A 103 is mounted above and below the linear electrodes 102 with only air present therebetween. Therefore, a corona discharge occurs, whereby the air is easily ionized and hence, a dust collection performance with a dust collection efficiency as high as 95% can be realized. Because the polarity of the linear electrodes 102 is minus, minus ions are repulsed from the linear electrodes 102 and not absorbed, whereby a large amount of minus ions can be released. However, the following disadvantages were made clear: the consumed power was increased because the discharged current generated by the corona discharge was as large as 140 μA, and the large discharged current and the minus polarity of the linear electrodes 102 resulted in an amount of ozone generated being equal to 103 ppb larger than that provided by a plus discharge and thus, a large amount of ozone was generated.

A charging section 101 in a third dust collector, which is a comparative example, is of substantially the same arrangement as the conventional charging section shown in FIG. 8, except that the earthed electrode plates A 103 are removed, and a voltage of −10 kV is applied to the linear electrodes 102.

A punched metal plate (not shown) having an infinite number of holes having a diameter of 5 mm is placed as a lattice plate at a location displaced by 80 mm in an upstream direction from the charging section, and is connected to earth. The discharged current hardly flows, and ozone is hardly generated, but only a performance with a dust collection efficiency of 40% which is a practical level or less is realized. This is presumed to be because an effect of ionizing the air is small due to a smaller amount of ozone generated An arrangement of a charging section 101 in a fourth dust collector, which is an example of the present invention, is shown in FIG. 1. An ion-generating means is formed in the following manner; each of surfaces of earthed electrode plates A 103 in the charging section in the first dust collector is coated with a tape of vinyl chloride to form an insulating coated layer 1, and a linear electrode 102 male of tungsten is interposed between the adjacent earthed electrode plates A 103. In this arrangement; a voltage of +5.7 kV is applied and as a result, a dust collection efficiency of 80% is realized, which is lower than those in the charging sections in the first and second dust collectors, but is a value corresponding to a sufficient practical level. The reason is considered to be that a number of ions generated is as large as 250,000/cc, and the ionization of the air occurs sufficiently. An electric field exists between the linear electrode 102 and the earthed electrode plate A 103, but the generation of a large discharged current due to the corona discharge is inhibited, because the surface of the earthed electrode plate A 103 is insulated. Therefore, although the applied voltage is the same as in the charging section in the first dust collector, the discharged current is 4 μA, which is very small as compared with 140 μA in each of the charging sections in the first and second dust collectors. Namely, the amount of power consumed is reduced by a value corresponding to a reduction in current because of the same discharged voltage. At the same time, ozone is hardly generated because of the small discharged current. Namely, it can be mentioned that only ions are generated without occurrence of the corona discharge.

In this way, the amount of power consumed and the amount of harmful ozone can be reduced by reducing the discharged current, thereby producing air soft to a human body.

A charging section in a fifth dust collector, which is an example of the present invention, is of the substantially same arrangement as the charging section in the fourth dust collector, but the voltage polarity of the linear electrode 102 shown in FIG. 1 is minus. In this case, a sufficiently practical dust-collection performance with a dust collection efficiency of 88% is exhibited. At the same time, a number of minus ions as large as 160,000/cc are released, because the voltage polarity of the linear electrode 102 is minus. The amount of power consumed is reduced, and the concentration of ozone generated is also as very small as 7 ppb, because the discharged current is as small as 12 μA.

In this way, it has been found that the amount of power consumed and the amount of harmful ozone can be reduced by reducing the discharged current, and at the same time, minus ions can be generated, thereby ensuring that the dust collector brings a good influence to a human body.

Figure 2:
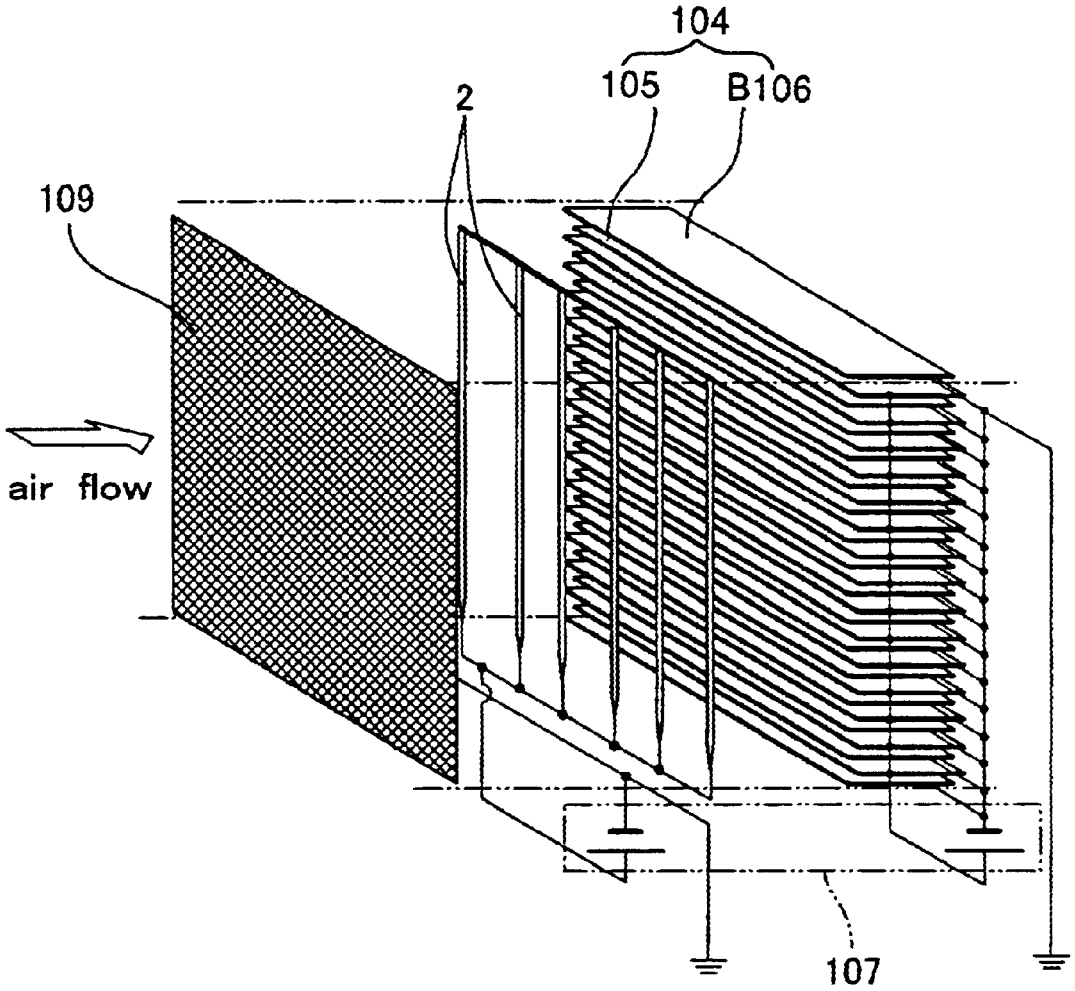
FIG. 2 is a diagram showing the arrangement of a dust collector constructed using needle-shaped electrodes according to an embodiment of the present invention.

An arrangement of a charging section in a sixth dust collector, which is an example of the present invention, is shown in FIG. 2. Six needle-shaped electrodes 2 each including a tip end pointed sharply and a main body having a diameter of 0.7 mm and a length of 30 mm are mounted as discharging electrodes side by side at distances of 30 mm in a direction perpendicular to an air flow direction in an intake port in a duct, and a voltage of −10 kV is applied to the needle-shaped electrodes 2. A punched metal plate of steel having an infinite number of holes each having a diameter of 5 mm is placed as a lattice plate 109 at a location displaced by 150 mm in an upstream direction from the needle-shaped electrodes 2 and is connected to earth. In this case, the dust collection efficiency is a sufficiently practical level of 85%. It can be seen that the sharp needles exhibit a more excellent air-ionizing performance than that exhibited by wires having a diameter of 0.15 mm, because the dust collection efficiency is high as compared with that provided by the charging section in the third dust collector. A number of minus ions as large as 270,000/cc are released, because the polarity of discharging electrodes is minus. The discharged current is as very small as 0.6 μA and hence, the amount of power consumed is small, and ozone is hardly generated. Electrons and ions collide against the surfaces of the discharging electrodes to some extent and for this reason, it is considered that the surfaces of the discharging electrodes are deteriorated to some extent. In a case of wires, however, there is a possibility that their surfaces are deteriorated to some extent, but are less worn, and the shape and function of the discharging electrodes themselves cannot be lost due to cutting or the like, because the discharged current is hardly generated.

A charging section in a seventh dust collector, which is an example of the present invention, is of the substantially same arrangement, except that a net made of a stainless steel and having a mesh of 20 is mounted as a lattice plate at a location displaced by 30 mm in a downstream direction from needle-shaped electrodes in place of the punched metal plate and is connected to earth, and a voltage of −8 kV is applied to the needle-shaped electrodes, so that a discharged current of 22 μA flows. The six needle-shaped electrodes are placed in a proportion of one in an area corresponding to about 70 mm square. The discharged current per one electrode is 3.7 μA. In order to suppress the discharged current to this value by only the insulation provided by the air, it is required that the distance between the needle-shaped electrodes and the earth is about 30 mm. The dust collection efficiency is 93% substantially equivalent to that in the charging section in the first dust collector, which is the comparative example, and the amount of ozone generated is 5 ppb, which is largely smaller than 24 ppb in the charging section in the first dust collector. A number of minus ions as large as 200,000/cc are released, and the discharged current is also as small as 22 μA. Therefore, it has been found that the amount of power consumed can be reduced.

A charging section 101 in an eighth dust collector, which is an example of the present invention, is of the substantially same arrangement. In this charging section 101, a net made of a stainless steel and having a mesh of 20 is mounted as earth at a location displaced by 30 mm in a downstream direction from needle-shaped electrodes, and the applied voltage and the discharged current are adjusted to −10 kV and 40 μA, respectively. The six needle-shaped electrodes are mounted in a proportion of one in an area corresponding to about 70 mm square. The discharged current per one electrode is 6.7 μA. The dust collection efficiency is 97% equivalent to or more than that in the charging section in the first dust collector as the comparative example, and the amount of ozone generated is 7 ppb, which is largely lower than 24 ppb in the charging section in the first dust collector. A number of minus ions as large as 270,000/cc are released, and the discharged current is as small as 40 μA. Therefore, it has been found that the amount of power consumed can be reduced.

The contents resulting from the foregoing facts are shown in Table 1.

TABLE 1

| | No. | Discharging electrode | Voltage applied to discharging electrodes Discharged current Discharged current per 0.1 mm on linear electrode or per one needle-shaped electrode | Earthed electrode plate | Polarity of ion | Concentration of ions Number/cc | Dust collection efficiency | Concentration of ozone ppb |
|---|---|---|---|---|---|---|---|---|
| Com. Ex. | 1 | Tungsten wire having diameter of 0.15 mm | +5.7 kV<br>140 μA<br>11 μA | Steel plate | + | 270,000 | 95% | 24 |
| Com. Ex. | 2 | Tungsten wire having diameter of 0.15 mm | −5.4 kV<br>140 μA<br>11 μA | Steel plate | − | 150,000 | 95% | 103 |
| Com. Ex. | 3 | Tungsten wire having diameter of 0.15 mm | −10 kV<br>0 μA<br>0 μA | Punched steel plate at location displaced upstream by 80 mm | − | 500 | 40% | 0 |
| Ex. | 4 | Tungsten wire having diameter of 0.15 mm | +5.7 kV<br>4 μA<br>0.3 μA | Steel plate coated with vinyl tape | + | 250,000 | 80% | 0 |
| Ex. | 5 | Tungsten wire having diameter | −5.7 kV<br>12 μA | Steel plate coated with vinyl | − | 160,000 | 88% | 7 |

TABLE 1-continued

| | No. | Discharging electrode | Voltage applied to discharging electrodes Discharged current Discharged current per 0.1 mm on linear electrode or per one needle-shaped electrode | Earthed electrode plate | Polarity of ion | Concentration of ions Number/cc | Dust collection efficiency | Concentration of ozone ppb |
|---|---|---|---|---|---|---|---|---|
| | | of 0.15 mm | 1 μA | tape | | | | |
| Ex. | 6 | Needle-shaped steel electrode having thickness of 0.7 mm | −10 kV 0.6 μA 0.1 μA | Punched steel plate at location displaced upstream by 150 mm | − | 270,000 | 85% | 0 |
| Ex. | 7 | Needle-shaped steel electrode having thickness of 0.7 mm | −8 kV 22 μA 3.7 μA | Stainless net with mesh of 20 at location displaced downstream by 30 | − | 200,000 | 93% | 5 |
| Ex. | 8 | Needle-shaped steel electrode having thickness of 0.7 mm | −10 kV 40 μA 6.7 μA | Stainless net with mesh of 20 at location displaced downstream by 30 | − | 270,000 | 97% | 7 |

Com. Ex. = Comparative example
Ex. = Example

In the case of the linear electrode as shown in the charging sections in the first and second dust collectors, which are the comparative examples, when a usual corona discharge occurs, the dust collection efficiency is high, but the amount of ozone generated is also very high. When only ions are generated at a discharged current of 1 μA or less according to the present invention, as shown in the charging sections in the fourth and fifth dust collectors, which are the examples of the present invention, the generation of ozone can be inhibited utmost, while maintaining the dust collection performance. However, when the discharged current is 0 (zero), as in the comparative example 3, there is little amount of ions generated, and the dust collection performance is also low. In order to maintain the dust collection performance, the discharged current is required to be equal to or more than 0.1 μA per 0.1 m of the linear electrode. In the charging section in the fifth dust collector, the voltage of the minus polarity is applied to the discharging electrodes and hence, a large amount of minus ions are released.

By using the needle-shaped discharging electrodes as the discharging electrodes and at the same time, setting the discharged current at a value equal to or smaller than 1 μA, as in the charging section in the sixth dust collector, which is the example of the present invention, the amount of power consumed and the amount of harmful ozone generated can be reduced to a large extent, and minus ions can be generated from the ion-generating means. Therefore, it has been found that the dust collector is of such an arrangement that a good influence is provided to a human body and at the same time, the discharging electrodes are less worn and deteriorated. Therefore, the dust collector can be used for a long period of time, and the maintenance cost can be reduced.

It is not desired that the dust collection efficiency is degraded to some extent, but if it is desired that the amount of power consumed and the amount of ozone generated are reduced, it can be achieved in the dust collector capable of releasing only ions without occurrence of a corona discharge. The amount of ozone generated can be reduced to one half of that in the conventional dust collector by setting the number of the needle-shaped electrodes such that at most one electrode is disposed in an area of 40 mm square on an air flow surface, so that the number is reduced and optimized, as compared with the conventional dust collector, as shown in the charging sections in the seventh or eighth dust collectors, which are the examples of the present invention. Thus, it is possible to reduce the amount of power consumed and the amount of harmful ozone generated, while achieving a dust collection performance equivalent to or higher than that in the conventional dust collector. At the same time, minus ions alleged to bring a good influence to a human body can be supplied by applying a voltage of a minus polarity.

It is shown in FIG. 2 that the lattice plate 109 is mounted at the location upstream of the needle-shaped electrodes 2, but even if the lattice plate 109 is mounted at a location downstream of the needle-shaped electrodes 2 as in the seventh dust collector, a similar effect is provided.

The linear electrode 102 made of tungsten is employed in the present embodiment, but a linear electrode 102 made of another material having an electric conductivity may be used in place of the linear electrode 102 made of tungsten and even in this case, a similar effect is provided.

The steel needle pointed sharply is used as the needle-shaped electrode 2 in the embodiment, but an electrode made of another material having an electric conductivity, if it can ionize the air, may be used in place of the steel needle, and yet, a difference is not produced between the effects.

The metal net made of the stainless steel and having the mesh of 20 is used as the conductive lattice plate 109 connected to the earth in the present embodiment, but the net, if it is air-permeable, may be of any rough mesh, or of any shape. For example, a conductive sheet made of a conductive fiber may be used and yet, a similar effect is provided.

The dust-collecting section is of an arrangement such that a difference in potential is provided between the voltage-applied electrode plate and the earthed electrode plate to form an electric field, so that mainly an electrostatically charged dust is collected by a force of the electric field. Alternatively, another type of a dust-collecting section may be used such as a filtering filter made using a glass fiber as a filter medium for mechanically collecting a dust, an electrostatic filter made using a dielectric material as a filter medium, so that an electric field can be formed within the filter, thereby collecting a dust mechanically or a force of the electric field, and an electric field filter sandwiched between electrodes, so that a voltage is applied to the filter, and a dust is placed in an electric field of a always consistent direction and collected by a force of the electric field consolidated into one direction. Even if such other type of the dust-collecting section is used, a similar effect is produced.

(Dust-collection Test Example 2 in Dust Collectors According to the Embodiment and in Conventional Dust Collector)

Discharge currents, dust collection efficiencies and pressure losses were compared with one another using a dust collector according to an embodiment of the present invention and having a feature in an ion-releasing means and a dust-collecting section, and using a conventional dust collector.

Figure 9:
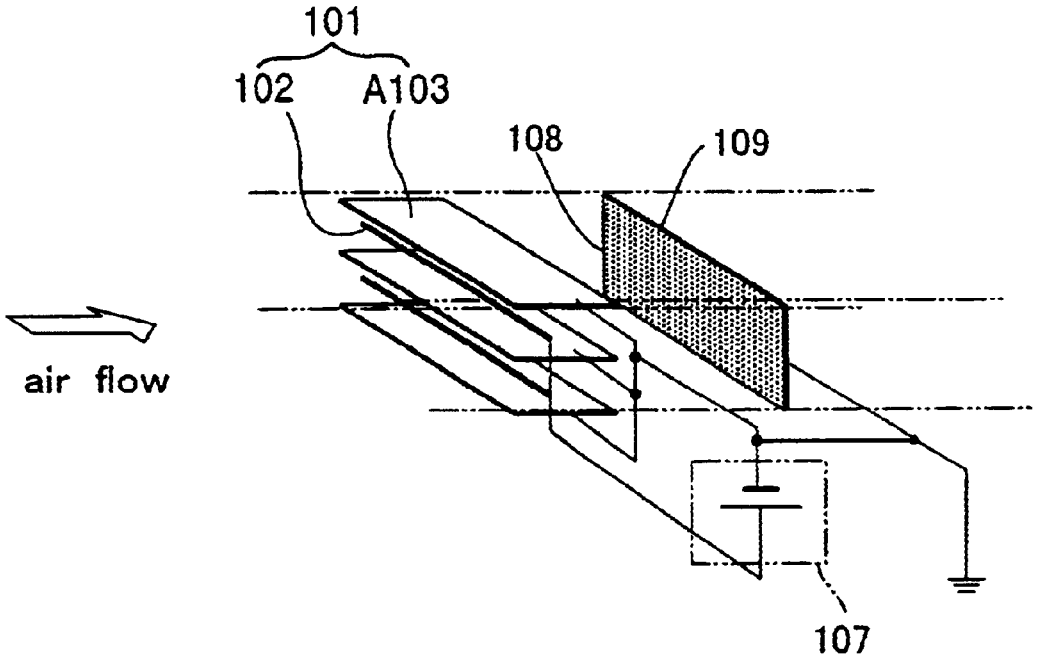
FIG. 9 PRIOR ART
FIG. 9 is a diagram showing the arrangement of a conventional dust collector.

The conventional dust colletor is shown in FIG. 9. A testing equipment was fabricated based on this dust collector. This testing equipment will be described below with reference to FIG. 9. A duct having an opening size of 100 mm×50 mm was made, and a charging section 101, a filter 108 and a lattice plate 109 were mounted in the named order from the upstream side in a air flow direction. The lattice plate 109 was mounted just after the filter 108 to come into contact with the filter 108. A mean-performance type of a filter medium made by Kurare was used to constitute the filter 108. This filter medium has a performance with a dust collection efficiency of about 50% (measured in a counting manner, 0.3 μm or more) by itself at a speed of air flow equal to 1 m/sec on a filter plane, and main component for the filter medium is polypropylene. A surfactant was previously contained in this filter, so that a dust deposited on the filter could be removed by washing to reuse the filter. In addition, the filter was designed to have a high rigidity, so that even if the filter was washed with water, it is kept in shape. A net made of a stainless steel and having a mesh of 20 and a wire diameter of 0.5 mm was used for the lattice plate 109. A speed of air passed through the duct was set at 1 m/sec. A DC voltage was applied to the discharging electrodes using a high-voltage regulated power supply 107, and a dust collection efficiency (%), a discharged current (μA) and a pressure loss (Pa) in the entire dust collector at that time were measured. Results are shown in Table 2.

TABLE 2

| | No. | Discharging electrode | Number of pleats | Voltage | Discharged current per 1 $m^3$/min | Dust collection efficiency | Pressure loss at 1 m/sec |
|---|---|---|---|---|---|---|---|
| Com. Ex. | 9 | Linear electrode Diameter of 0.15 mm | 0 (no ridges) | 0 kV | 0 μA | 50% | 580 Pa |
| | | Thickness of 100 mm | | 5.0 kV | 2 μA | 69% | |
| | | Number: 2 | | 5.5 kV | 13 μA | 92% | |
| Ex. | 10 | Needle-Shaped electrode | 0 (no ridges) | 0 kV | 0 μA | 50% | 580 Pa |
| | | Thickness of 0.7 mm | | −4 kV | 0.3 μA | 76% | |
| | | Length of 30 mm | | −5 kV | 0.6 μA | 86% | |
| | | Number: 1 | | −6 kV | 2.3 μA | 92% | |
| Ex. | 11 | Needle-Shaped electrode Thickness of 0.7 mm | 6 (3 ridges) | 0 kV | 0 μA | 50% | 170 Pa |
| | | Length of 30 mm | | −4 kV | 0.3 μA | 91% | |
| | | Number: 1 | | −6 kV | 1.7 μA | 94% | |

Com. Ex. = Comparative example
Ex. = Example

The discharged current is shown as being in terms of 1 $m^3$/min and as being 3.33 times a measured value. The dust collection efficiency was determined by measuring a concentration of dust just before the charging section 101 and a concentration of dust just after the lattice plate 109 using Particle Counter KC-01C made by Rion. The concentration of dust was determined in a counting manner by sampling 0.167 liter of air and measuring the entire number of dust particles having a particle size of 0.3 μm equal to or larger than and contained in such amount of air.

The arrangements of these charging sections will be described below with reference to FIGS. 3, 4 and 9.

The charging section in the ninth dust collector, which is a comparative example, is of the same arrangement as in the conventional charging section shown in FIG. 9. In this charging section, two linear electrodes 102 each made using a wire made of tungsten and having a diameter of 0.15 mm and a length of 100 mm are placed at a distance of 24 mm and at two stages vertically in an air flow direction, and a voltage of 0 to 5.5 kV is applied to the linear electrodes. Three earthed electrode plates A 103 made of a steel and having a length of 15 mm and a width of 100 mm as viewed in the air flow direction were placed at equal distances, so that each of the linear electrodes was interposed between the adjacent earthed electrode plates A 103. A distance between the linear electrode 102 and a lattice plate 109 was 25 mm. This charging section 101 was a charging section of a shape conventionally commonly used. The earthed electrode plates A 103 were mounted around the linear electrodes 102 with only air present as an insulating material therebetween, so that a corona discharge occurred between both of the electrodes, and air was easily ionized in the vicinity of the linear electrodes 102. Therefore, the dust collection efficiency was 92% at an applied voltage of 5.5 kV, and thus, the dust collection performance of the filter equal to 50% at 0 kV was increased remarkably. However, a discharged current of 13 $\mu$A in terms of 1 $m^3$/min flowed, because the corona discharge generating a large discharged current was allowed to occur in order to ionize the air. It should be noted that when a voltage of 5.0 kV is applied to the discharging electrodes to permit a discharged current of 2 $\mu$A in terms of 1 $m^3$/min to flow, the dust collection efficiency is 69% and hence, it is not true that when a very small discharged current is permitted to flow, the dust collection performance provided is enhanced sufficiently.

Figure 3:
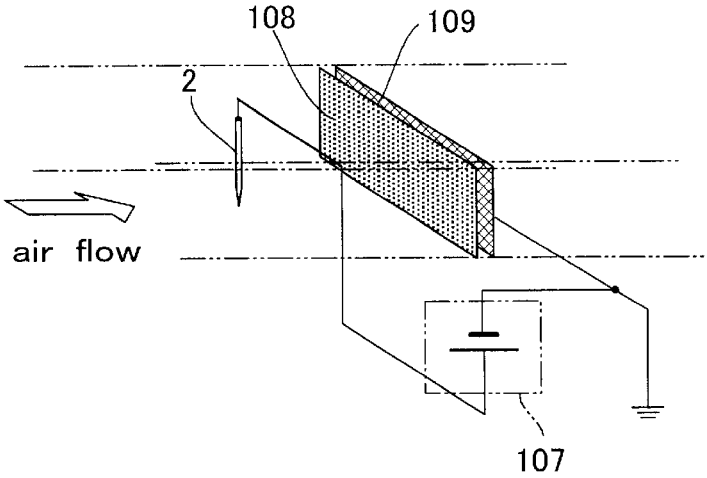
FIG. 3 is a diagram showing the arrangement of a dust collector including a filter between a needle-shaped electrode and a lattice plate connected to earth according to an embodiment of the present invention.

The arrangement of a charging section in a tenth dust collector, which is an example of the present invention, is shown in FIG. 3. A single needle-shaped electrode 2 including a tip end pointed sharply and a body having a diameter of 0.7 mm and a length of 30 mm is mounted as a discharging electrode vertically to an air flow direction in a central portion of a duct. A filter 108 is mounted at a location spaced downstream by 30 mm apart from the needle-shaped electrode 2, and a lattice plate 109 is mounted just after filter 108. The needle-shaped electrode 2 and the lattice plate 109 are of a structure in which they are partitioned off by not only air but also a filter 108. When the lattice plate 109 was connected to earth, and a voltage of 0 to −6 kV was applied to the needle-shaped electrode 102, the dust collection efficiency was 92% at −6 kV, and the dust collection performance of the filter equal to 50% at 0 kV was enhanced remarkably. The discharged current at that time was 2.3 $\mu$A in terms of 1 $m^3$/min, which was about ⅙ of the discharged current provided when the dust collection efficiency was likewise 92% in the ninth dust collector which is the comparative example, and hence, this value of 2.3 $\mu$A was very small. When a voltage of −5 kV was applied to the needle-shaped electrodes 2, the dust collection efficiency was increased largely to 86%, and the discharged current at that time was 0.6 $\mu$A in terms of 1 $m^3$/min. The number of the needle-shaped electrodes used was one, and the high dust collection efficiency could be obtained at the discharged current of 1 $\mu$A or less per one discharging electrode. Because the insulation distance between the voltage-applied needle-shaped electrode 2 and the lattice plate 109 was sufficient and the needle-shaped electrode 2 and the lattice plate 109 were partitioned off by the filter having the insulating property, an excessive discharged current could be suppressed, and ions could be released from the needle-shaped electrodes without occurrence of the corona discharge, thereby electrostatically charging the dust. By this fact and by the fact that the filter was kept polarized by the electric field, a stable high dust collection performance could be provided to the filter.

Figure 4:
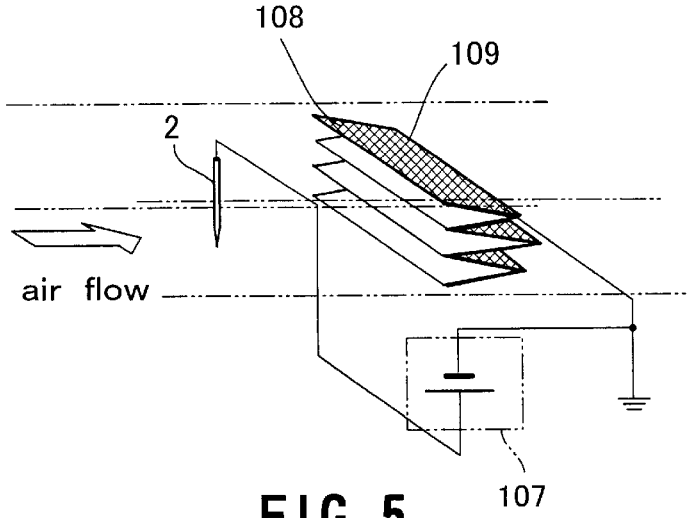
FIG. 4 is a diagram showing the arrangement of a dust collector including a filter between a needle-shaped electrode and a lattice plate formed into a pleated shape and connected to earth according to an embodiment of the present invention.

The arrangement of an eleventh dust collector, which is an example of the present invention, is shown in FIG. 4. A needle-shaped electrode 2 is mounted as a discharging electrode. A filter 108 folded in six into a pleated shape with a width of 30 mm in an air flow direction was mounted at a location displaced downstream by 30 mm from the needle-shaped electrode 2, and a lattice plate 109 likewise folded in six into a pleated shape was mounted just after filter 108 to come into contact with a surface of the filter. In the eleventh dust collector of the example of the present invention, the lattice plate 109 is in contact with the surface of the filter, but is not necessarily in contact with the surface of the filter and may be disposed in proximity to the surface of the filter. This dust collector is also of a structure in which the needle-shaped electrode 2 and the lattice plate 109 are partitioned off by not only air but also the filter 108, as in the ninth dust collection of the comparative example. The lattice plate 109 was connected to earth, and a voltage of 0 to −6 kV was applied to the needle-shaped electrode. The result showed that the dust collection efficiency was 94% at −6 kV, and a dust collection performance further higher than that of the ninth dust collector could be provided. The discharged current at that time was 1.7 $\mu$A, which was about ⅛ of the discharged current provided when the dust collection efficiency of 92% was provided in the ninth dust collector of the comparative example. Thus, this value of 1.7 $\mu$A can be mentioned to be practically vary small. When a voltage of −4 kV was applied to the needle-shaped electrode, the dust collection efficiency was increased largely to 91%, and the discharged current at that time was 0.3 $\mu$A in terms of 1 $m^3$/min. The number of the needle-shaped electrode 2 used is one, as in the tenth dust collector, and a high dust collection efficiency could be provided at a discharged current of 1 $\mu$A per one discharging electrode. The reason why the stable and high dust collection performance could be provided at the very small discharged current as described above is the same as in the tenth dust collector which is the example of the present invention. The dust collection performance was higher than that in the tenth dust collector is because the speed of air passing through the filter surface was reduced by forming each of the filter and the lattice plate into the pleated shape. Further, the comparison of the pressure losses showed that the pressure loss was 580 Pa at a speed of air flow of 1 m/sec in the ninth dust collector of the comparative example with the filter and the lattice plate not subjected to the pleating, while the pressure loss in the eleventh dust collector as the example of the present invention was 170 Pa which was reduced to ⅓ to ¼ of that in the ninth dust collector. The air flowing energy is correspondingly reduced and hence, it is possible to reduce the rotational speed of the fan to reduce the air flowing cost and the noise. When dust is deposited to the filter and as a result, the dusting and clogging of the filter appeared significantly, the filter can be reused by washing the filter to remove the dust and then drying the filter, because the washable filter medium is used. If it is desired that the filter is reused many times by washing, the filter after being washed may be immersed into a liquid containing a surfactant and then dried. If the filter is treated in such a manner, a washable filter can be provided.

Figure 5:
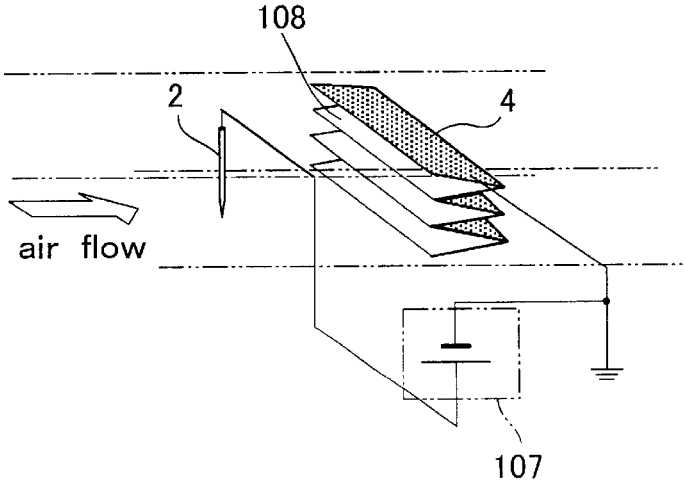
FIG. 5 is a diagram showing the arrangement of a dust collector comprising a needle-shaped electrode and a filter, to a back of which a conductive coating is applied.

The arrangement of a dust collector including a filter having a conductive layer formed thereon by applying a conductive coating onto a back of the filter, and a needle-shaped electrode will be described with reference to FIG. 5.

To polarize a filter medium and to escape extra electric charge deposited on the filter medium to the outside, a conductive lattice plate connected to earth is required at a location downstream of the filter. When a filter formed into a plated shape by a folding treatment is used, it is preferred that the lattice plate is subjected to a pleating in correspondence to the shape of the filter and in this case, the dust collection performance can be enhanced. However, if the number of pleats is increased, it is difficult to pleat the lattice plate and further, the pleated area of the lattice plate is increased, resulting in increases in treating cost and material cost. Even when the filter is not subjected to a treatment for providing a pleated shape, if an earth face can be formed on a back of the filter without provision of a conductive lattice plate, the manufacturing of the filter can be simplified and the material cost can be also reduced correspondingly. Therefore, a coating containing a substance having a conductivity such as carbon black is applied to one surface of a filter 108 and dried. By such treatment, a conductive layer 4 can be formed on the one surface of the filter 108. A needle-shaped electrode 2 and the filter 108 having the conductive layer 4 formed on the back are placed in the named order in an air flow direction, i.e., the filter 108 is placed at a location downstream of the needle-shaped electrode in the air flow direction, and the surface of the conductive layer 4 is connected to earth. Thus, an earthed surface can be formed on the back of the filter 108 without provision of a conductive lattice plate formed into a pleated shape. To form the conductive layer 4, either of the following procedures may be employed: One of the procedures comprises subjecting the filter medium to a plating treatment to produce the filter 108 and then applying the conductive coating to one surface of the filter 108, and the other procedure comprises applying the conductive coating to a flat surface of the filter medium before being subjected to the pleating treatment, thereby previously forming the conductive layer 4 on one surface of the filter medium, and then subjecting the filter medium to the pleating treatment to produce the filter.

Then, a high voltage can be applied to the needle-shaped electrode 2 to produce an electric field between the needle-shaped electrode 2 and the back of the filter 108, so that the filter medium of the filter 108 can be polarized by the electric field.

A net having a mesh of 20 and made of a stainless steel was used as a conductive lattice plate connected to earth in the present embodiment. However, the net may be of any mesh roughness and any shape, if air can be blown through the net. For example, even if a conductive sheet made by treating a conductive fiber is used, a similar effect can be provided.

The filter medium of the filter used in the present experiment was produced using polypropylene as a main component, but any other material, if it has a polarizability, may be used such as polyethylene, polyethylene fluoride, polyester and polyamide. Even in this case, a similar effect is provided.

Only when the opposed earthed electrode plate is coated with an insulating coating layer, or is removed to inhibit the corona discharge and reduce the discharged current, even if a linear electrode made using a tungsten wire is used as a discharging electrode in place of the needle-shaped electrode, an effect similar to that provided when the needle-shaped electrode is used as the discharging electrode is provided.

Although the carbon black is shown by example as the substance containing the conductive coating in the present embodiment, another conductive substance, for example, a conductive filler such as a metal fiber or a conductive polymer may be used as a substance containing a conductive coating. In such case, there is little difference between the effects.

If the polarity of the voltage applied to the needle-shaped electrode 2 is minus, which is particularly not described in the present embodiment, it is of course that minus ions said to have a good effect of relaxing the human's frame of mind can be released simultaneously.

(Embodiment of Air-conditioning System Including Dust Collector of the Present Invention)

Figure 6:
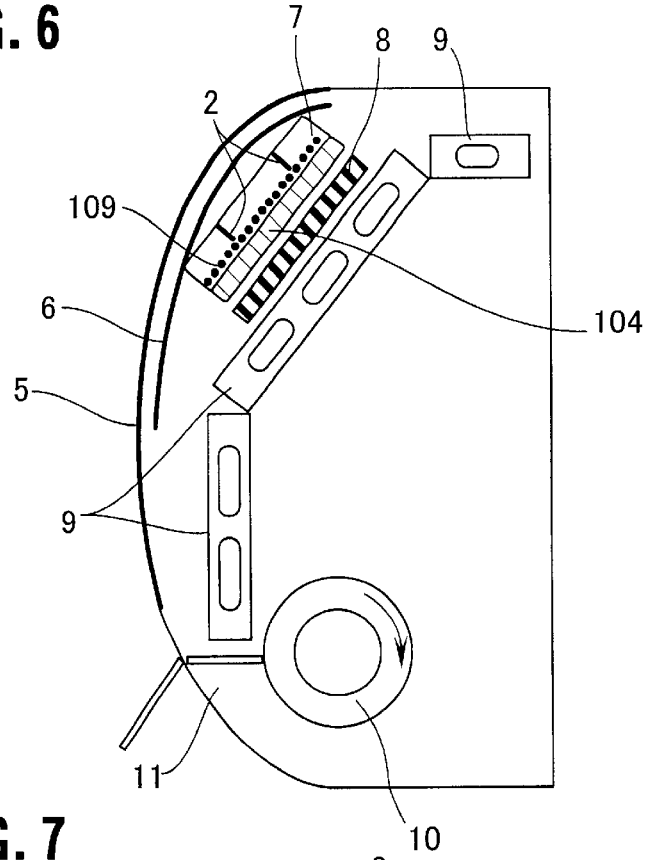
FIG. 6 is a diagram of an air-conditioning system including a dust collector constructed using a needle-shaped electrode according to an embodiment.

The arrangement of an air-conditioning system (an air conditioner) including the dust collector according to the above-described embodiment will be described with reference to FIG. 6. In the air-conditioning system, a suction grille 5, a coarse dust filter 6 for removing a large-particle dust, a dust collector 7 including a needle-shaped electrode 2, an earthed conductive lattice plate 109 and a dust-collecting section 104, as shown in the example 1, a photo catalyst unit 8, a heat exchanger 9, a fan 10 and a blow-off port 11 are arranged sequentially in the named order from a blow-in side in an air path within a body of the air-conditioning system. In the above arrangement, a dust and a cigarette smoke generated in a room are drawn into the air-conditioning system through the suction grille 5, and larger particles of the dust such as cotton dust particles are collected in the coarse dust filter 6 formed into a net-shape. Then, fine particles having a particle size of mainly 0.1 to 10 $\mu$m are collected in the dust collector 7. The dust is electrostatically charged by minus ions (or plus ions) supplied from the needle-shaped electrode 2 provided at a location upstream of the dust collector 7 and then collected by the dust-collecting section 104 provided at a location downstream of the needle-shaped electrode 2. At this time, the amount of ozone generated from the needle-shaped electrode 2 is very small. An odor which is a component having a molecule incapable of being collected in the dust collector 7 is removed in the photo catalyst unit 8. A deodorizing filter having activated carbon filled therein as an adsorbent has been conventionally used as a deodorizing mechanism. If the adsorbing capacity of the activated carbon is saturated, the deodorizing performance is lost and for this reason, the activated carbon is replaced such every time by new activated carbon for reuse of the deodorizing filter. However, a photo catalyst deodorizing has been recently used as a substitute for the deodorizing filter. This photo catalyst deodorizing can be used semipermanently, because it decomposes an odor component by a catalytic action. The photo catalyst unit 8 is capable of being reactivated by sunshine and hence, the deodorizing performance of the photo catalyst unit 8 can be restored by drying the photo catalyst unit 8 in the sun on a bright day. The air cleaned in the above-described manner is heat-exchanged by the heat exchanger 9, whereby the temperature thereof is varied to any level, and the comfortable air cleaned and set at any temperature is supplied from the blow-off port 11 through the fan 10. In this manner, an air-cleaning function serving not only to condition the air but also capable of producing air soft to a human body can be provided to the air-conditioning system. This air-cleaning function ensures that air-conditioning system can supply minus ions commonly alleged to provide a good influence to a human body such as a relaxing effect, while reducing the small amount of power consumed and the small amount of ozone generated.

Figure 7:
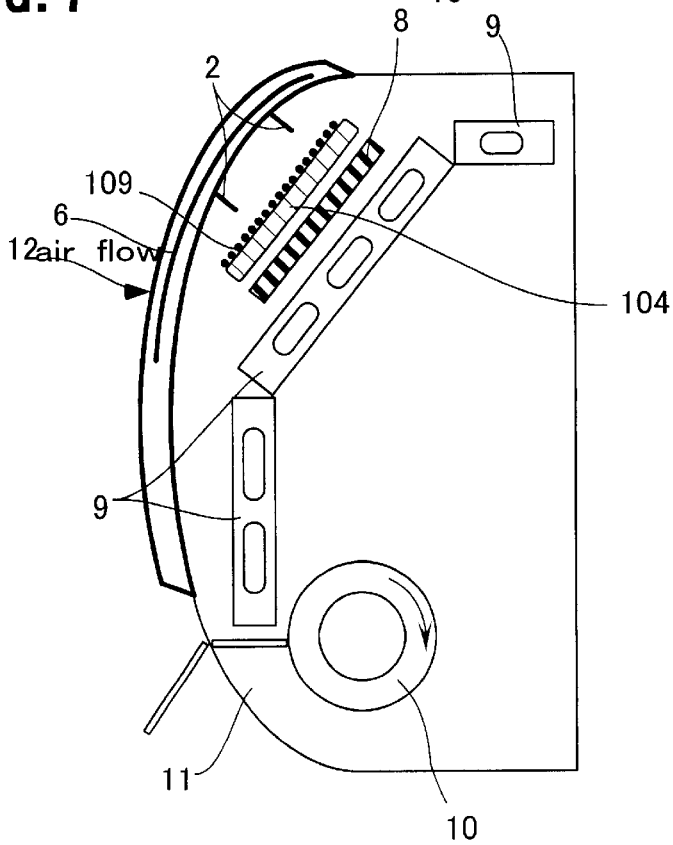
FIG. 7 is a diagram of an air-conditioning system including a dust-collecting section with a needle-shaped electrode and a grille formed integrally with each other according to an embodiment.

The arrangement of another air-conditioning system is shown in FIG. 7, which includes a needle-shaped electrode/grille assembly 12 comprising a suction grille and a needle-shaped electrode formed integrally with each other, and a dust-collecting section 104 provided in a body of the air-conditioning system. The air-conditioning system is of the same arrangement as the air-conditioning system shown in FIG. 6, except that a needle-shaped electrode 2 which is a charging section of a dust collector is placed inside the suction grille 12, and a coarse dust filter 6 for collecting large particles of a dust is mounted within the suction grille 12. By constructing the needle-shaped electrode/grille assembly 12 by forming the suction grille 12 and the needle-shaped electrode 2 integrally with each other, the thickness of the body of the air-conditioning system can be reduced, leading to a compact structure. In addition, the structure is such that the dust-collecting section 104 can be removed independently and hence, the maintenance of the dust-collecting section 104 such as washing and replacement can be enhanced remarkably.

Although the example of the dust collector according to the present invention incorporated in the air conditioner has been illustrated in the present embodiment, the dust collector maybe incorporated into any of various appliances and industrial machines such as a fan heater, a dehumidifier and the like.

Effect of the Invention

As can be seen from the above description, according to the present invention, it is possible to provide a dust collector designed, so that the energy used for collecting the dust can be reduced and the amount of harmful ozone produced can be reduced, thereby producing air softer to a human body.

In addition, it is possible to a dust collector which is adapted to produce air soft to a human body with a reduction in energy used for collecting the dust and with a reduction in amount of harmful ozone generated, and which has an effect of providing a good influence to the human body by generating minus ions simultaneously.

Further, it is possible to provide a dust collector in which the discharging electrode is less worn, and which has an effect of reducing the frequency of the maintenance such as replacement.

Yet further, it is possible to provide a dust collector having an effect of exhibiting a dust collection performance cleaning the polluted environment at a high level for a long period.

Yet further, it is possible to provide an air-conditioning system capable of realizing an environment of a high quality to a human by mounting a dust collector in the air-conditioning system.

Yet further, it is possible to provide an air-conditioning system including a dust collector, in which even if the dust-collecting function is applied, the body is left compact, and a dust-collecting section can be removed independently, whereby the maintenance property of the dust-collecting section can be enhanced.

What is claimed is:

1. A dust collector comprising an ion-releasing means for releasing ions without generation of a corona discharge, and a dust-collecting section placed at a location downstream of the ion-releasing means, wherein the ion releasing means includes a single or a plurality of discharging electrodes which are needle-shaped electrodes having sharp tip ends and discharged current per one needle-shaped electrode is 1 $\mu$A or less.

2. A dust collector according to claim 1, wherein the ion-releasing means releases minus ions.

3. A dust collector according to claim 1, wherein said ion-releasing means releases minus ions.

4. A dust collector according to claim 1, further including an insulating material or a semiconductor mounted around a tip end portion of the needle-shaped electrode to produce no corona discharge.

5. A dust collector according to claim 1, wherein one or less needle-shaped electrode is disposed per area of 40 mm square on an air flow surface.

6. A dust collector according to claim 1, wherein a conductive lattice plate connected to earth is placed at a location downstream of the needle-shaped electrode, and a filter comprising a filter medium constituting the dust-collecting section is mounted between the needle-shaped electrode and the lattice plate.

7. A dust collector according to claim 6, wherein the filter and the conductive lattice plate are formed into a pleated shape and disposed in such a manner that they are superposed one on another.

8. A dust collector according to claim 1, wherein a filter comprising a filter medium is mounted at a location downstream of the needle-shaped electrode, said filter having a conductive layer formed thereon by applying a conductive coating onto a downstream surface of said filter, said conductive layer being connected to earth.

9. A dust collector according to claim 8, wherein the filter is formed into a pleated shape.

10. A dust collector comprising an ion-releasing means for releasing ions without generation of a corona discharge, and a dust-collecting section placed at a location downstream of the ion-releasing means, wherein the ion-releasing means includes a single or a plurality of discharging electrodes which are linear electrodes, and earthed electrodes mounted on opposite sides of the linear electrode, the electrode connected to earth to provide discharged current of 1 $\mu$A or less per 0.1 m of the linear electrode upon application of a high voltage to the linear electrode, said earthed electrode being coated with an insulating material or a semiconductor.

11. A dust collector, comprising an ion-releasing means for releasing ions without generation of a corona discharge, and a dust-collecting section placed at a location downstream of the ion-releasing means, wherein the ion-releasing means includes a single or a plurality of discharging electrodes which are linear electrodes, and earthed electrodes mounted on opposite sides of the linear electrode, the electrode connected to earth to provide discharged current of 1 $\mu$A or less per 0.1 m of the linear electrode upon application of a high voltage to the linear electrode, said earthed electrode being coated with an insulating material or a semiconductor, and said ion releasing means releases minus ions.

12. An air-conditioning system including a dust collector according to any one of claims 1–11.

13. An air-conditioning system including a dust collector according to any one of claims 3–9, said dust collector being provided with a needle-shaped electrode mounted directly on a grille to provide a dust-collecting function of electrostatically charging a dust and collecting the dust in a dust-collecting section provided within the dust collector.

* * * * *